US010912370B2

(12) United States Patent
Broughton et al.

(10) Patent No.: US 10,912,370 B2
(45) Date of Patent: Feb. 9, 2021

(54) MODULAR COSMETIC PEN

(71) Applicants: Maria Sofia Broughton, Mountain View, CA (US); Adriana Catalina Coulson, San Jose, CA (US)

(72) Inventors: Maria Sofia Broughton, Mountain View, CA (US); Adriana Catalina Coulson, San Jose, CA (US)

( * ) Notice: Subject to any disclaimer, the term of this patent is extended or adjusted under 35 U.S.C. 154(b) by 266 days.

(21) Appl. No.: 15/917,322

(22) Filed: Mar. 9, 2018

(65) Prior Publication Data

US 2018/0255907 A1 Sep. 13, 2018

Related U.S. Application Data

(60) Provisional application No. 62/469,406, filed on Mar. 9, 2017.

(51) Int. Cl.

| | |
|---|---|
| ***A45D 40/18*** | (2006.01) |
| ***A45D 40/20*** | (2006.01) |
| ***A45D 34/02*** | (2006.01) |
| ***A45D 34/04*** | (2006.01) |
| ***A45D 40/02*** | (2006.01) |
| ***A45D 40/26*** | (2006.01) |
| ***A45D 40/06*** | (2006.01) |

(52) U.S. Cl.

CPC ..... *A45D 40/18* (2013.01); *A45D 40/20* (2013.01); *A45D 34/02* (2013.01); *A45D 34/041* (2013.01); *A45D 34/042* (2013.01); *A45D 40/02* (2013.01); *A45D 40/06* (2013.01); *A45D 40/262* (2013.01)

(58) Field of Classification Search

CPC ..... A45D 40/18; A45D 40/24; A45D 40/02; A45D 40/06; A45D 40/265; A45D 34/00; A45D 2034/005; A45D 34/045; A45D 34/06; A45D 2040/0012; A45D 2040/0025

USPC ..... 416/16–19, 52

See application file for complete search history.

(56) References Cited

U.S. PATENT DOCUMENTS

| | | | | |
|---|---|---|---|---|
| 3,941,488 A * | 3/1976 | Maxwell | B43K 27/08 401/17 |
| 5,279,499 A * | 1/1994 | Carter | A45D 34/042 401/205 |
| 5,338,123 A * | 8/1994 | Obersteller | B43K 23/06 401/17 |
| 5,941,254 A * | 8/1999 | Heler | A45D 40/18 132/218 |

(Continued)

*Primary Examiner* — Rachel R Steitz
*Assistant Examiner* — Karim Asqiriba

(57) ABSTRACT

The modular cosmetic pen is an apparatus that compacts a writing instrument and a cosmetic tool together while preserving a streamline and ergonomic structure. The apparatus includes a writing instrument, an adapter, at least one cosmetic tool, and a cover. The writing instrument is preferably a pen; however, the writing instrument may be a variety of applied writing instruments. The writing instrument preferably includes a twist mechanism that extends and retracts a dispensing tip. The dispensing tip preferably expels ink. The adapter connects the at least one cosmetic tool to the writing instrument. The at least one cosmetic tool is connected to the adapter, positioned opposite the writing instrument. The at least one cosmetic tool includes a cosmetic applicator and a cap, and preferably a tube which serves as a reservoir for a cosmetic. The cover is removably attached to the adapter over the at least one cosmetic tool.

5 Claims, 16 Drawing Sheets

(56) References Cited

U.S. PATENT DOCUMENTS

| | | | | |
|---|---|---|---|---|
| 6,357,943 | B1 * | 3/2002 | Kuang | B43K 29/05 401/17 |
| 6,921,223 | B2 * | 7/2005 | Marschand | B43K 23/008 401/17 |
| 7,654,762 | B2 * | 2/2010 | Carlino | A45D 33/26 401/17 |
| 8,534,945 | B2 * | 9/2013 | Muhr-Sweeney | B08B 1/00 15/104.94 |
| 8,596,897 | B2 * | 12/2013 | Cole | A45D 40/00 401/195 |
| 2003/0194255 | A1 * | 10/2003 | Silberman | A45D 34/04 401/18 |
| 2013/0170888 | A1 * | 7/2013 | Sheena | A45D 40/04 401/195 |
| 2015/0189973 | A1 * | 7/2015 | Swain | A45D 40/18 401/18 |
| 2017/0127800 | A1 * | 5/2017 | Lambdin | A45D 40/18 |

* cited by examiner

MODULAR COSMETIC PEN

The current application claims priority to U.S. provisional application Ser. No. 62/469,406 filed on Mar. 9, 2017.

FIELD OF THE INVENTION

The present invention relates generally to pens. More specifically, the present invention is a modular cosmetic pen.

BACKGROUND OF THE INVENTION

A variety of cosmetic, hygiene, and general wellness devices have become commonplace in daily life for many people. Particularly for women, availability of a variety of cosmetic tools and devices is essential to maintain appearances and social status. Bags, purses, and the like are often carried in order to simplify the process of transporting an overwhelming quantity of cosmetic devices, along with other a variety of essential items. Essential items may include wallets, phones, keys, and so on. Common cosmetic devices include lipstick, lip-balm, deodorant, perfume bottles, eye-shadow, mascara, oil blends, mouth sprays, and so on.

However, the physical space occupied by many cosmetic devices require additional storage space. By utilizing a set of cosmetic devices that are completely separate from each other, there is more wasted space for storage. Locating a specific cosmetic tool also becomes increasingly difficult. Therefore, a combination of common cosmetic tools and essential items will lessen the difficulty of locating any item within a bag or purse. Furthermore, this combination will increase empty space within a bag or purse and enhance the organization within the bag or purse.

It is therefore an objective of the present invention to effectively combine cosmetic tools and essential items into a single device. More specifically, the present invention connects a writing utensil and at least one cosmetic tool in order to accommodate to woman with busy everyday schedules and women who are managing everyday tasks. The present invention camouflages the writing utensil and the at least one cosmetic tool into a single writing utensil, thereby reducing the space occupied by both items within a bag or a purse.

DETAILED DESCRIPTION OF THE INVENTION

All illustrations of the drawings are for the purpose of describing selected versions of the present invention and are not intended to limit the scope of the present invention.

Figure 1:
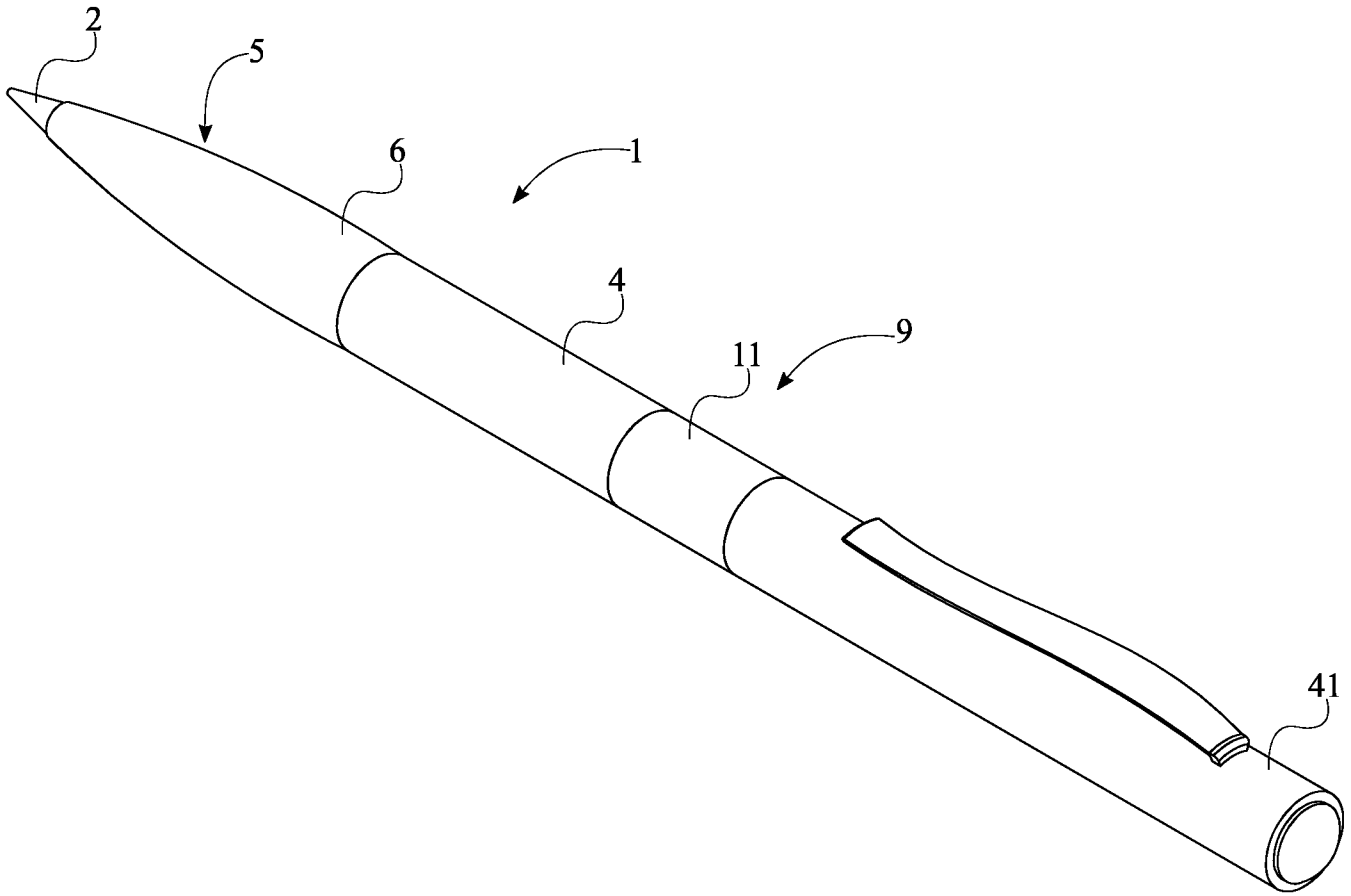
FIG. 1 is a top perspective view of the preferred embodiment of the present invention.
Figure 2:
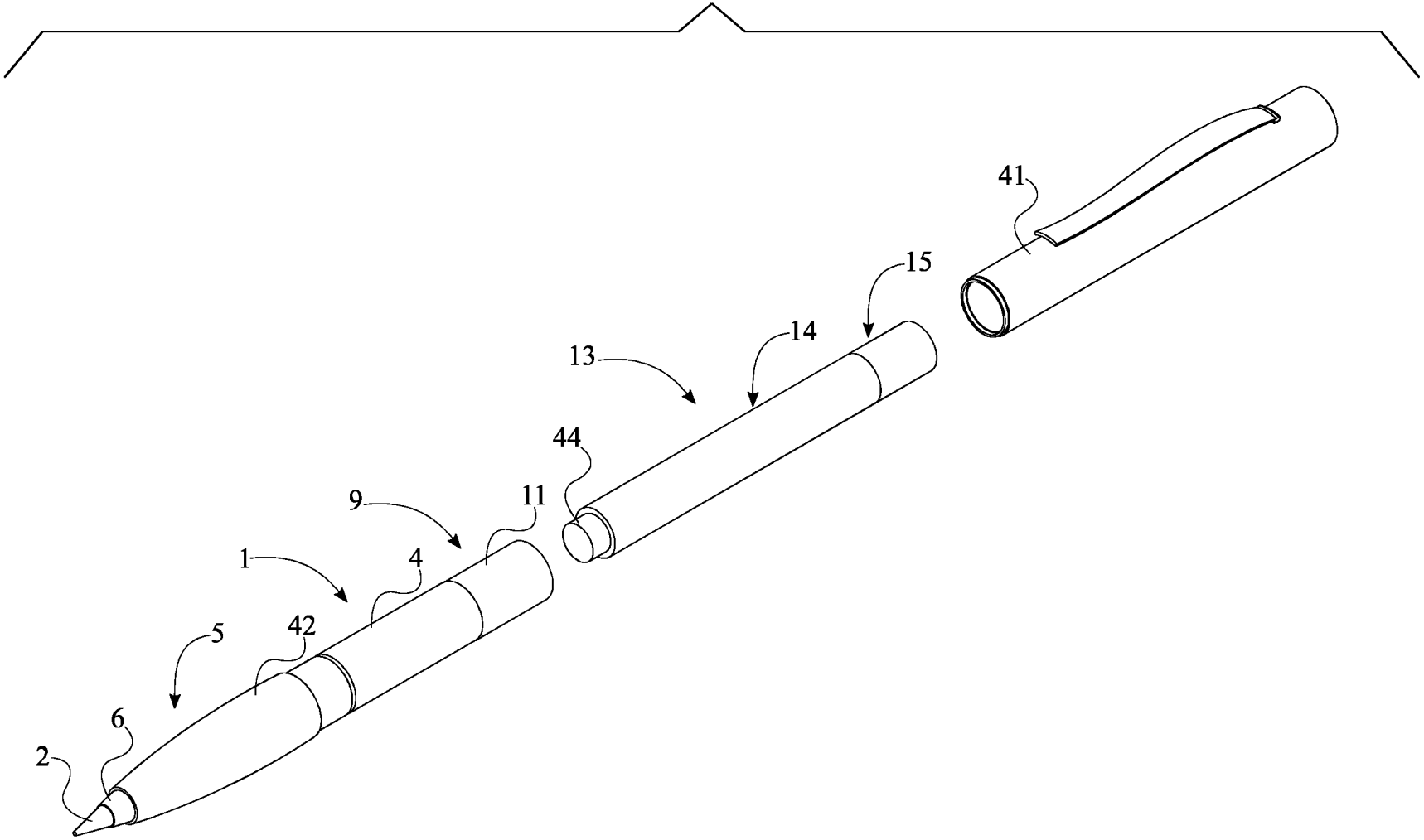
FIG. 2 is a bottom exploded view of the preferred embodiment of the present invention, with a gripping sleeve.

The present invention is modular cosmetic pen that effectively combines a writing instrument 1 and a cosmetic tool into a single apparatus. The present invention serves as a discrete cosmetic tool for a user with a busy professional life, personal life, or both. In order for the user to have access to both a writing instrument 1 and a cosmetic tool from a single apparatus, the present invention comprises a writing instrument 1, an adapter 9, at least one cosmetic tool 13, and a cover 41, as seen in FIG. 1 and FIG. 2. The writing instrument 1 allows the user to manually write messages, notes, and a variety of other texts and drawings onto paper or a variety of items. In the preferred embodiment of the present invention, the writing instrument 1 is a pen. In alternate embodiments of the present invention, the writing instrument 1 may be a mechanical pencil, a marker, or a variety of assisted writing instruments. More specifically, the writing instrument 1 comprises a dispensing tip 2, a chamber 3, and a barrel 4, shown in FIG. 6, FIG. 8, FIG. 9, FIG. 11, FIG. 13, and FIG. 15. The dispensing tip 2 delivers pigment onto an adjacent surface. The pigment is preferably ink of a pen and the dispensing tip 2 is preferably a ballpoint tip. The chamber 3 is a reservoir of pigment, preferably ink. The barrel 4 houses the chamber 3. In the preferred embodiment of the present invention, the barrel 4 houses the dispensing tip 2 upon the retraction of the dispensing tip 2.

As seen in FIG. 2, the at least one cosmetic tool 13 contains a cosmetic item in a compact and portable manner. The at least one cosmetic tool 13 may be, but is not limited to, perfume rollerball 22, lipstick or chapstick, perfume spray, mascara, and eyeshadow. More specifically, the at least one cosmetic tool 13 comprises a cosmetic applicator 14 and a cap 15. The cosmetic applicator 14 delivers a cosmetic to the skin of the user. The cap 15 houses the cosmetic applicator 14. The source or reservoir of the cosmetic may be integrated with the cosmetic applicator 14 or the cap 15.

Figure 3:
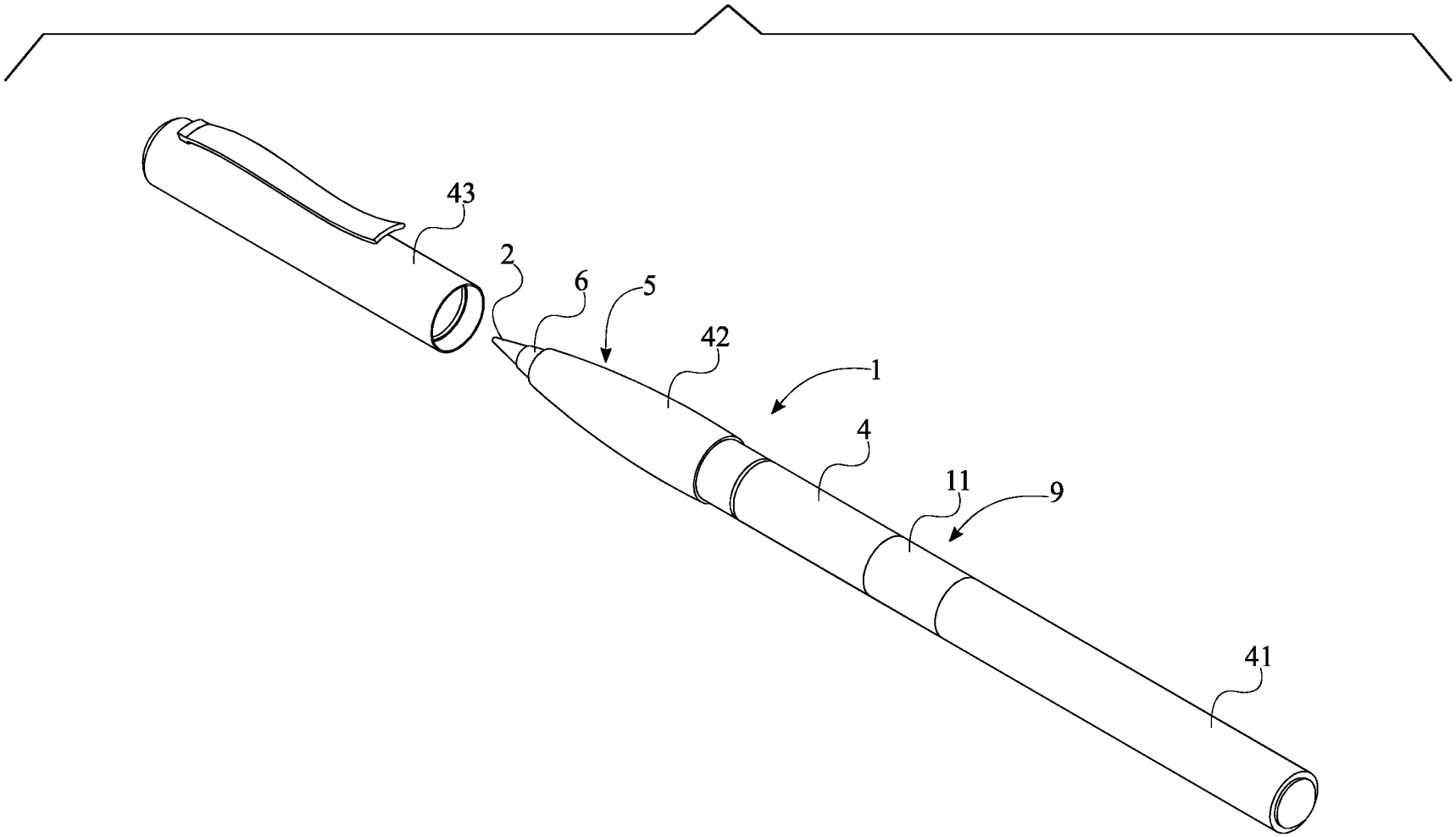
FIG. 3 is a top exploded view of an alternate embodiment of the present invention with a writing instrument cap and a gripping sleeve.
Figure 5:
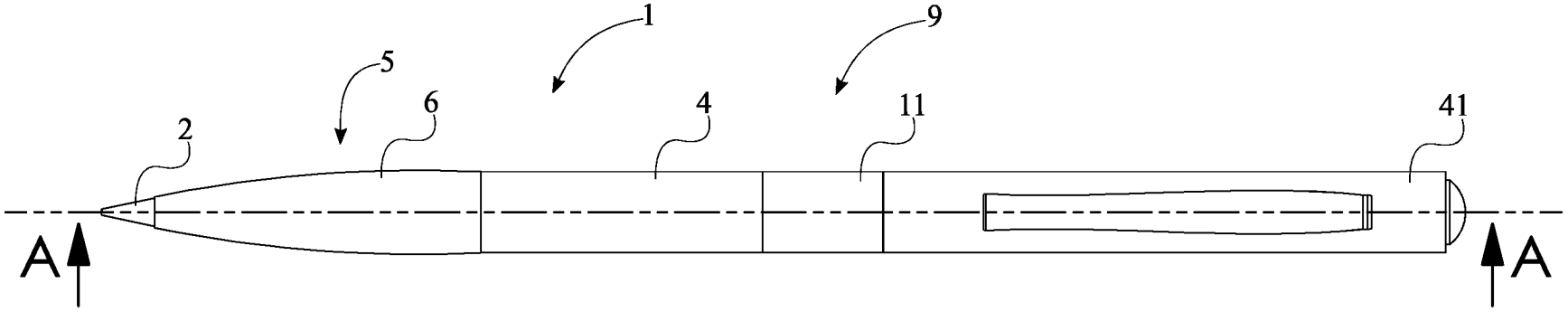
FIG. 5 is a top view of the preferred embodiment of the present invention.

As shown in FIG. 1, FIG. 2, and FIG. 3, the adapter 9 serves as a universal attachment for a variety of at least one cosmetic tool 13. The adapter 9 connects the pen to the at least one cosmetic tool 13. As shown in FIG. 5, the cover 41 houses and conceals the at least one cosmetic tool 13 that is connected to the adapter 9.

The overall configuration of the aforementioned components allows a user to access both a writing utensil and a cosmetic tool from a compact apparatus. In order for a user to manually write, the dispensing tip 2 is in fluid communication with the chamber 3, allowing ink to flow from within the chamber 3 through the dispensing tip 2. This arrangement is seen in shown in FIG. 6, FIG. 8, FIG. 9, FIG. 11, FIG. 13, and FIG. 15.

The chamber 3 is mounted within the barrel 4 and the dispensing tip 2 is positioned external to the barrel 4. This arrangement allows the user to maneuver and write with the writing instrument 1. The adapter 9 is fixed to the barrel 4, positioned opposite the chamber 3, thereby allowing the at least one cosmetic tool 13 to be removed and interchanged. In order to preserve the streamline structure of standard writing utensil, seen in FIG. 2, the cosmetic applicator 14 is connected to the adapter 9, positioned opposite the barrel 4, and the cap 15 is removably attached to the cosmetic applicator 14, positioned opposite the adapter 9. More specifically, the writing instrument 1, the adapter 9, and the at least one cosmetic tool 13 is positioned concentrically with each other. In the preferred embodiment of the present invention, the barrel 4 tapers from the adapter 9 to the dispensing tip 2, preserving an ergonomic structure of the present invention. As seen in FIG. 1 and FIG. 2, the at least one cosmetic tool 13 is concealed as the cover 41 is removably attached to the adapter 9 over the adapter 9. This arrangement camouflages the present invention as solely a writing utensil. Furthermore, the separation of the cover 41 from the remainder of the apparatus maintains the connection between the cosmetic applicator 14 and the adapter 9 until the cosmetic applicator 14 is purposefully separated. In alternate embodiments of the present invention, clips and decorative ornaments may be mounted onto the cover 41 in order to better conceal the at least cosmetic tool housed within the cover 41.

In order to enhance the present invention as a writing utensil, and more specifically as a pen, the writing instrument 1 further comprises a twist mechanism 5, seen in FIG. 1, FIG. 6, FIG. 8, FIG. 9, FIG. 11, FIG. 13, and FIG. 15. The twist mechanism 5 opens and closes the pen so that the ink released from the dispensing tip 2 does not accidentally tarnish a surface. The writing instrument 1 is manually opened and closed as twist mechanism 5 is rotatably connected to the barrel 4, opposite the adapter 9. The twist mechanism 5 is operatively coupled within the chamber 3, wherein the twist mechanism 5 is configured to extend and retract the dispensing tip 2 within an opening 7 of a tubular casing 6 of the twist mechanism 5. The dispensing tip 2 is shown in a retracted configuration in FIG. 16. Moreover, the user may grasp the tubular casing 6 of the twist mechanism 5 in order to manually extend and retract the dispensing tip 2. An alternate embodiment of the present invention may further comprise a gripping sleeve 42, as shown in FIG. 2 and FIG. 3. The gripping sleeve 42 increases the friction between the grasp of the user and the tubular casing 6 in order to facilitate the rotation of the tubular casing 6. In order to better maneuver the tubular casing 6, the gripping sleeve 42 is mounted around the tubular casing 6 of the twist mechanism 5. In the preferred embodiment with the dispensing tip 2 being retractable and in alternate embodiments with the dispensing tip 2 being stationary within the barrel 4, the present invention further comprises a writing instrument cap 43. In this alternate embodiment, the writing instrument cap 43 houses a writing end of the writing instrument 1. The writing instrument cap 43 is removably attached to the barrel 4 over the dispensing tip 2, thereby further ensuring that the dispensing tip 2 does not accidentally come into contact with a nearby surface.

In order to effectively connect the at least one cosmetic tool 13 to the writing instrument 1 with the adapter 9, the adapter 9 comprises an adapter base 11 and a shaft-receiving slot 12, and the at least one cosmetic tool 13 comprises a main shaft 44, seen in FIG. 2, FIG. 4, FIG. 7, FIG. 10, FIG. 12, and FIG. 14. The main shaft 44 connects the at least one cosmetic tool 13 to the adapter 9. The adapter base 11 mounts the at least one cosmetic tool 13 to the writing instrument 1, and the shaft-receiving slot 12 houses the main shaft 44. In order to connect the at least one cosmetic tool 13 to the adapter 9 without blocking the connection between the cosmetic applicator 14 and the cap 15, the main shaft 44 is terminally fixed to the cosmetic applicator 14, opposite the cap 15. In order to preserve a streamline and an ergonomic structure, the shaft-receiving slot 12 concentrically traverses into the adapter base 11, opposite the barrel 4, thereby positioning the writing instrument 1 and at least one cosmetic tool 13 with each other. This arrangement is shown in FIG. 6, FIG. 8, FIG. 9, FIG. 11, FIG. 13, and FIG. 15. In order to secure the at least one cosmetic tool 13 with the adapter 9, the main shaft 44 is threadedly engaged with the shaft-receiving slot 12. The user may simply twist the at least one cosmetic tool 13 from the adapter 9 in order use the writing instrument 1 and the at least one cosmetic tool 13 separately or interchange either.

Figure 4:
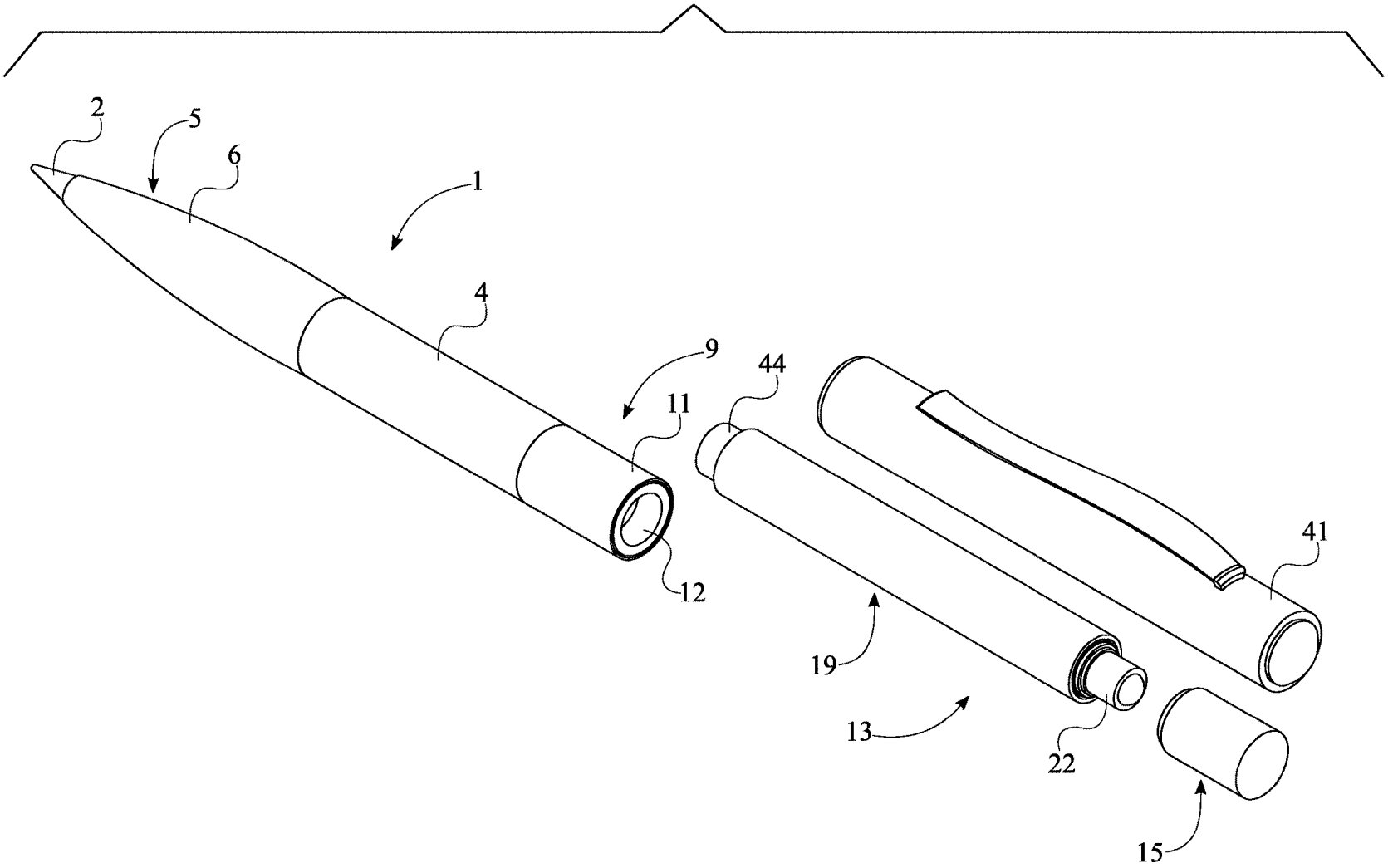
FIG. 4 is a top exploded view of a first alternate embodiment of the present invention with the at least one cosmetic tool and the cover separated from the present invention.
Figure 6:
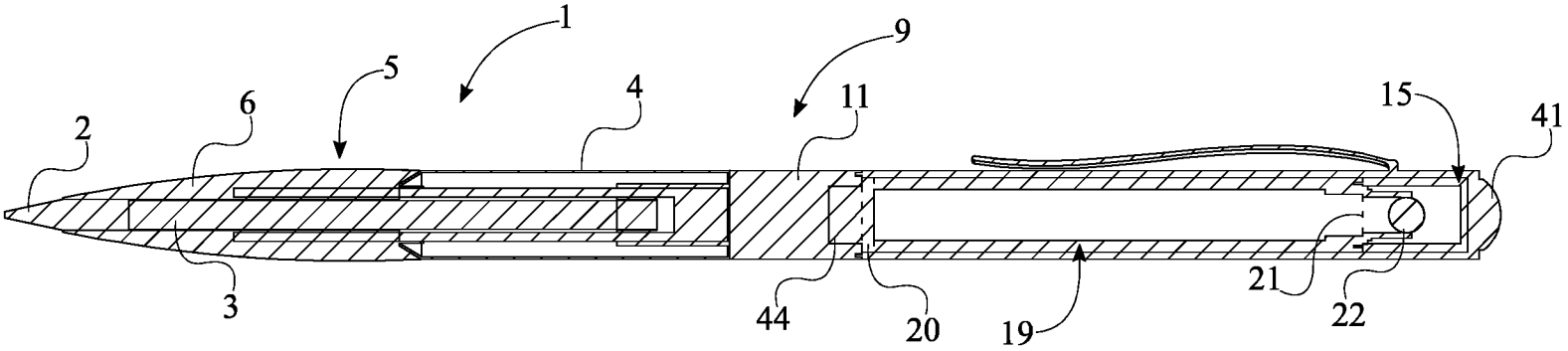
FIG. 6 is a cross-section view of FIG. 5 along line A-A of the first embodiment of the present invention.

In a first embodiment of the present invention, the at least one cosmetic tool 13 is a rollerball tube that preferably houses perfume, shown in FIG. 4 and FIG. 6. This embodiment may also dispense deodorant to aid in hygiene maintenance or essential oils to enhance an overall wellbeing. In this embodiment, the at least one cosmetic tool 13 comprises a tube 19 and a rollerball 22. The tube 19 contains perfume and serves as a reservoir of perfume for the rollerball 22. The rollerball 22 applies the perfume onto an adjacent surface only if a ball of the rollerball 22 is pressed across the adjacent surface. The adapter 9 is preferably connected to a tube base 20 of the tube 19, opposite an opening 21 of the tube 19, and the rollerball 22 is mounted to the tube 19, adjacent the opening 21 of the tube 19. This arrangement stabilizes the at least one cosmetic tool 13 with the writing instrument 1, facilitating the application of the rollerball 22 against the adjacent surface. In order for to prevent the rollerball 22 from accidentally coming into contact with an adjacent surface, the cap 15 is removably attached to the tube 19 over the rollerball 22.

Figure 7:
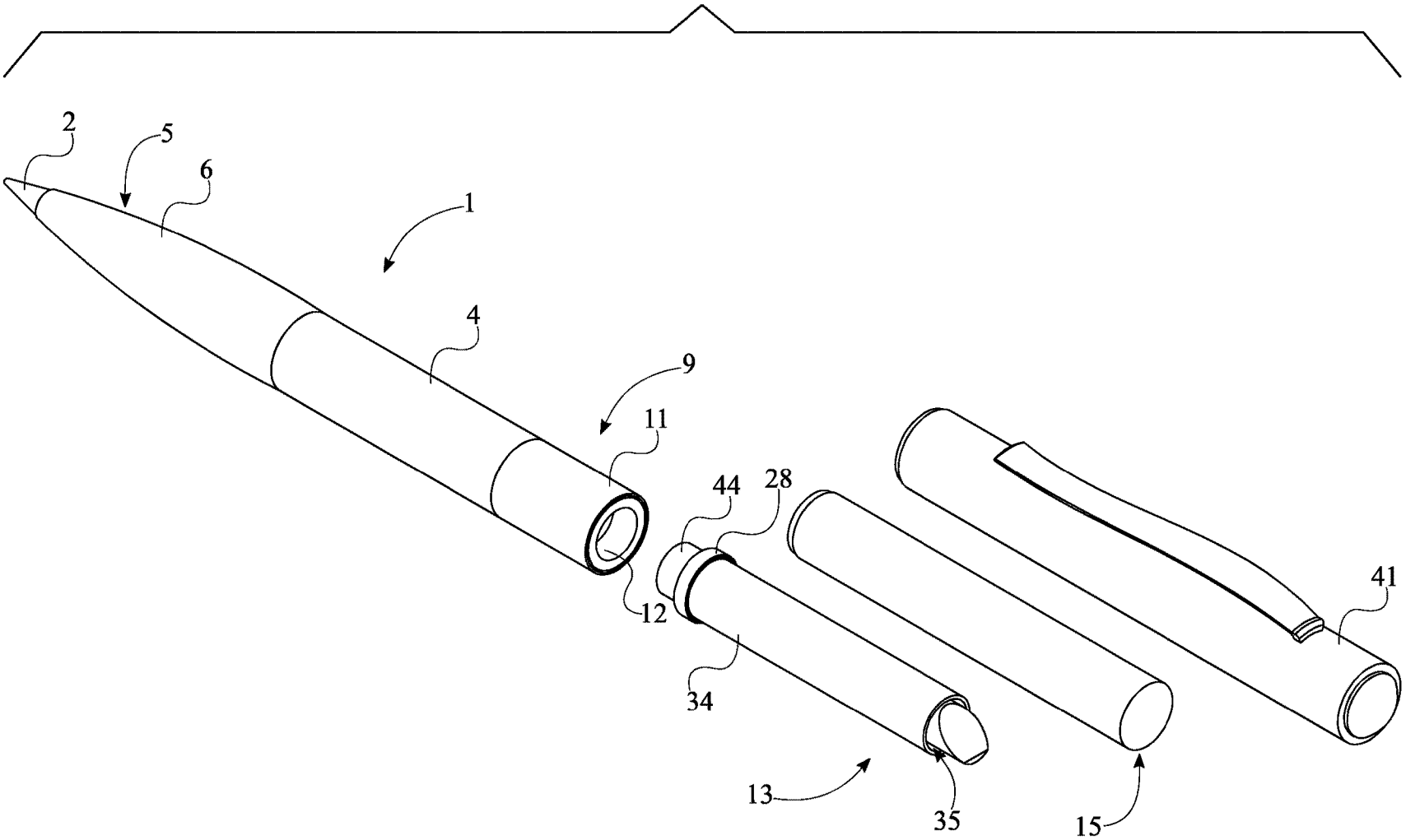
FIG. 7 is a top exploded view of a second alternate embodiment of the present invention with the at least one cosmetic tool and the cover separated from the present invention.
Figure 8:
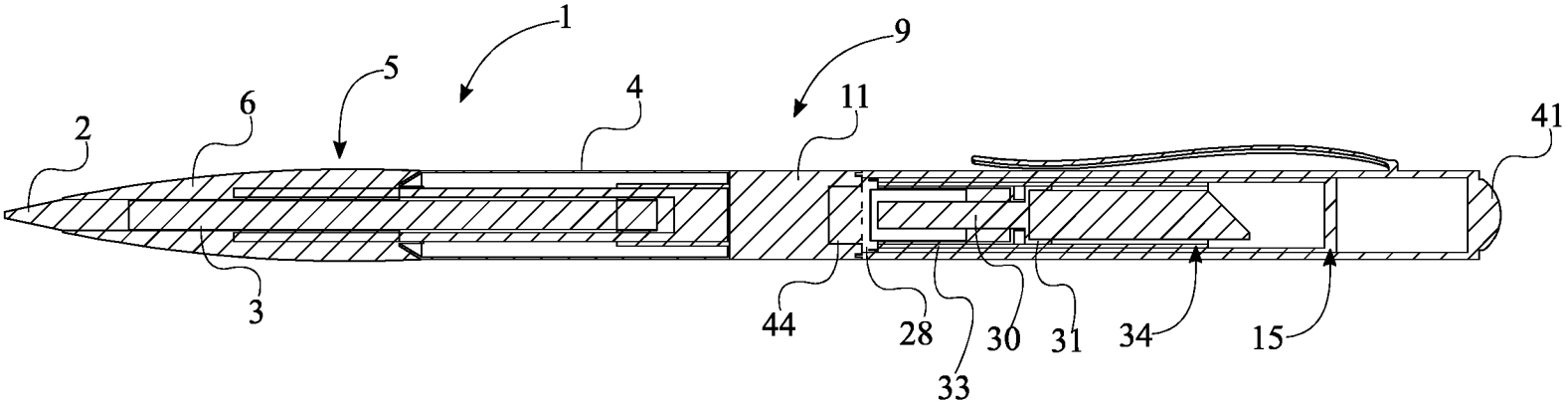
FIG. 8 is a cross-section view of FIG. 5 along line A-A of the second embodiment of the present invention.
Figure 9:
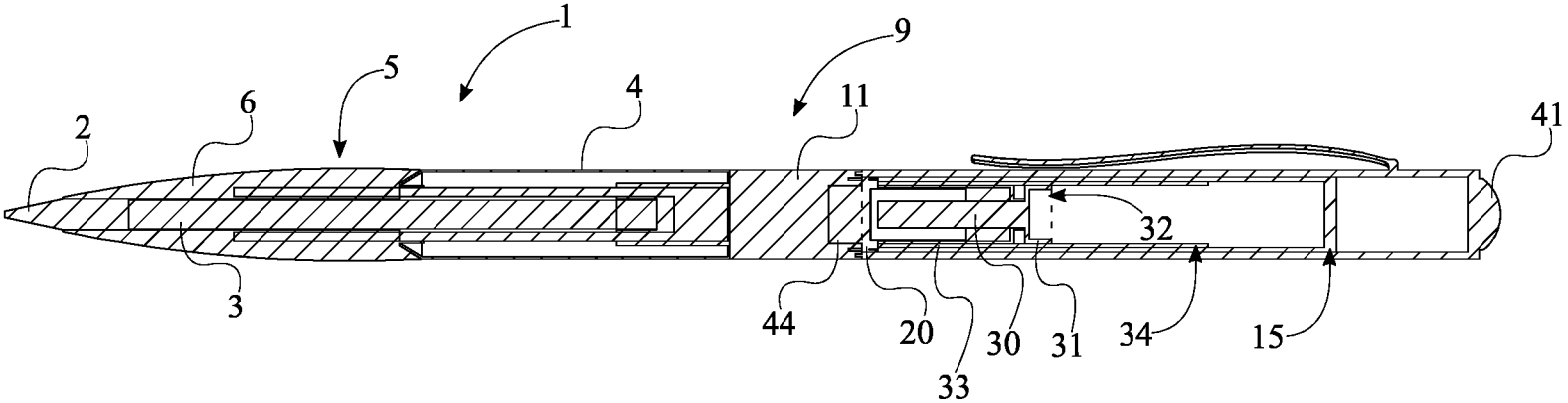
FIG. 9 is a cross-section view of FIG. 5 along line A-A of the second embodiment of the present invention without a lipstick paste housed within the at least one cosmetic tool.

In a second embodiment of the present invention, the at least one cosmetic tool 13 is a dispenser for lip cosmetic, shown in FIG. 7, FIG. 8, FIG. 9. More specifically, in this embodiment, the at least one cosmetic tool 13 is lipstick. This embodiment may also dispense lip balm which serves to sooth the lips rather than simply enhance the aesthetic appearance of the lips as with lipstick. In order to dispense lipstick, the at least one cosmetic tool 13 comprises a tool base 28, a rod 30, a bed 31, a sleeve 33, and a tube 34. The tool base 28 connects at least one cosmetic tool 13 to the adapter 9, the rod 30 connects the bed 31 to the sleeve 33 and allows the bed 31 to traverse across the tube 34. The bed 31 upholds and mounts lipstick paste within the tube 34. The sleeve 33 rotates the bed 31, and the tube 34 conceals and houses the lipstick paste mounted onto the bed 31. Similar to the first embodiment, the adapter 9 is connected to the tool base 28, opposite an opening 29 of the tool base 28. The tube 34 is rotatably coupled to the tool base 28, opposite the adapter 9, and the sleeve 33 is terminally mounted within the tube 34, positioned adjacent the tool base 28, thereby allowing a user to rotate the bed 31 without coming into contact with the lipstick paste until the lipstick paste exits the tube 34. The rod 30 is threadedly engaged with the sleeve 33 and the opening 29 of the tool base 28 in order to extend and retract the bed 31 with the rotation of the tube 34. In order to access the lipstick paste mounted onto the bed 31, the bed 31 is terminally fixed to the rod 30. More specifically, an opening 32 of the bed 31, seen in FIG. 9, is positioned adjacent an opening 35 of the tube 34, and the opening 35 of the tube 34 is positioned opposite the tool base 28. The lipstick paste within the tube 34 is protected and concealed as the cap 15 is removably attached to the tool base 28 over the tube 34.

Figure 10:
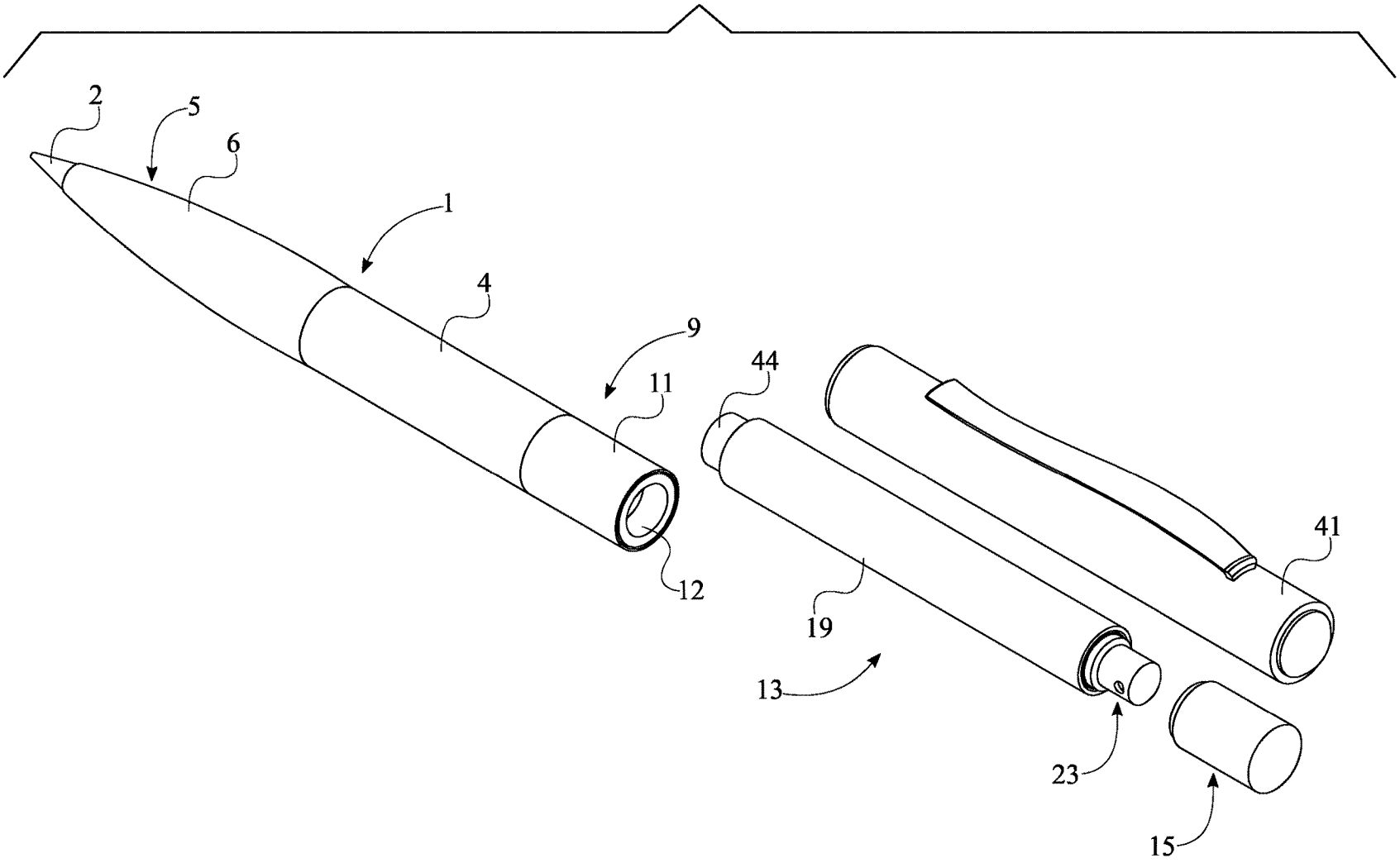
FIG. 10 is a top exploded view of a third alternate embodiment of the present invention with the at least one cosmetic tool and the cover separated from the present invention.
Figure 11:
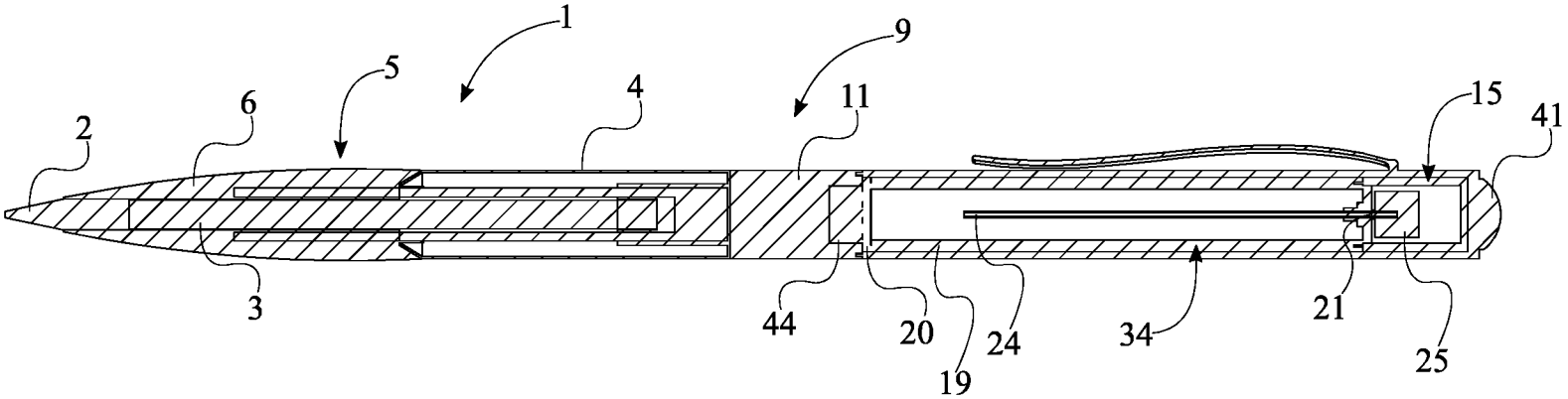
FIG. 11 is a cross-section view of FIG. 5 along line A-A of the third embodiment of the present invention.

In a third embodiment of the present invention, the at least one cosmetic tool 13 is a mist spray tube, shown in FIG. 10 and FIG. 11. In this embodiment, the at least one cosmetic tool 13 comprises a tube 19 and mist spray pump 23. The tube 19 preferably contains mouthwash and serves as a reservoir of mouthwash for the mist spray pump 23. In this embodiment, the tube 19 may also contain perfume if the user does not wish to have perfume rolled onto skin or clothing. The mist spray pump 23 dispenses the perfume within the tube 19, moreover, the mist spray pump 23 sprays the perfume. The adapter 9 is preferably connected to a tube base 20 of the tube 19, opposite an opening 21 of the tube 19, and the mist spray pump 23 is mounted to the tube 19, adjacent the opening 21 of the tube 19. This arrangement stabilizes the at least one cosmetic tool 13 with the writing instrument 1, facilitating the engagement of the mist spray pump 23. In order to dispense and spray the perfume within the tube 19, a supply tube 24 of the mist spray pump 23 is positioned within the tube 19, and a spray nozzle 25 of the mist spray pump 23 is positioned external to the tube 19. More specifically, the spray nozzle 25 is in fluid communication with the supply tube 24. In order to prevent the accidentally pressing of the spray nozzle 25, the cap 15 is removably attached to the tube 19 over the spray nozzle 25.

Figure 12:
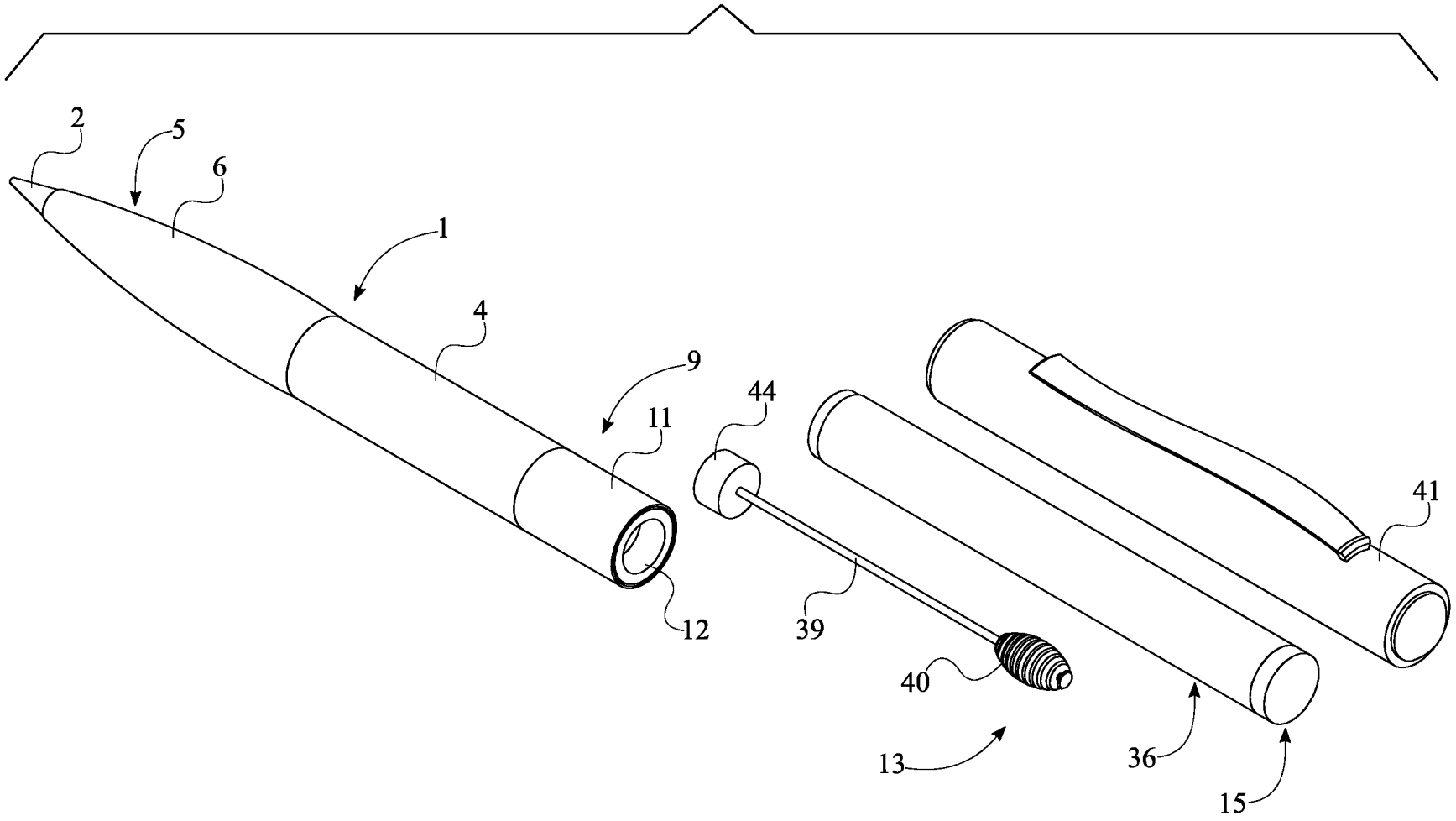
FIG. 12 is a top exploded view of a fourth alternate embodiment of the present invention with the at least one cosmetic tool and the cover separated from the present invention.
Figure 13:
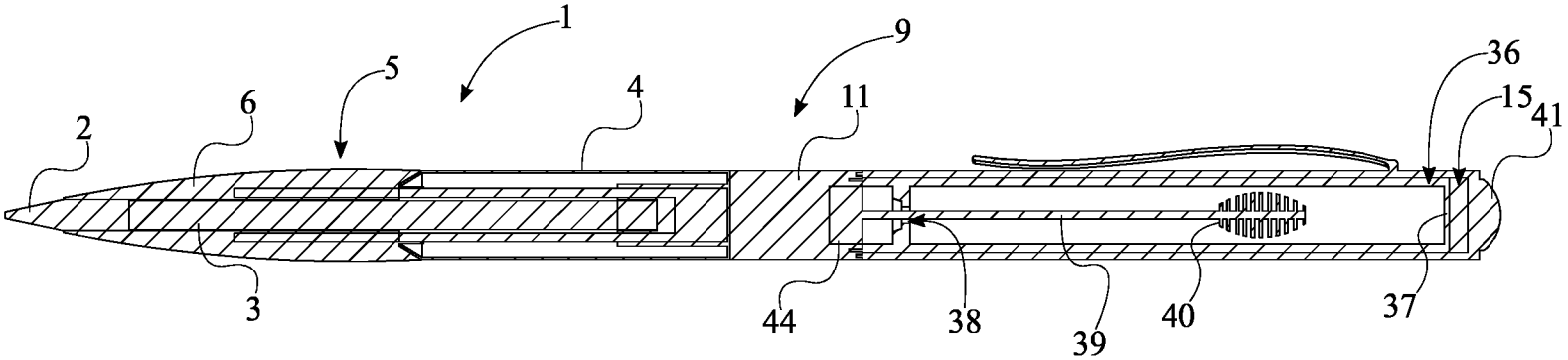
FIG. 13 is a cross-section view of FIG. 5 along line A-A of the fourth embodiment of the present invention.

In a fourth embodiment of the present invention, the at least one cosmetic tool 13 is mascara tube and mascara applicator, shown in FIG. 12 and FIG. 13. In this embodiment, the at least one cosmetic tool 13 comprises a tube 36, a shaft 39, and a mascara brush 40. The tube 36 contains the mascara paste and serves as a reservoir of mascara paste for the mascara brush 40. The shaft 39 positions the mascara brush 40 with the tube 36, in order for the mascara brush 40 to access all of the mascara paste within the tube 36. The shaft 39 also allows a user to maneuver the mascara brush 40 without the hand of the user coming into contact with the mascara brush 40. The mascara brush 40 applies the mascara paste onto at least one surface, the at least one surface preferably being eyelashes. In order to effectively maneuver the mascara brush 40, the shaft 39 is mounted onto the adapter 9, opposite the barrel 4 of the writing instrument 1, and the mascara brush 40 is fixed to the shaft 39, opposite the adapter 9. The shaft 39 is preferably mounted onto the adapter 9 with the main shaft 44 and the main shaft 44 is threadedly engaged with the shaft-receiving slot 12 of the adapter 9. The cap 15 is connected to a tube base 37 of the tube 36, opposite an opening 38 of the tube 36, thereby allowing the mascara brush 40 to access the mascara paste within the tube 36. In order to seal the tube 36 and preserve the mascara paste within the tube 36, the adapter 9 is positioned adjacent the opening 38 of the tube 36, and the tube 36 is removably attached to the adapter 9. This positions the shaft 39 and the mascara brush 40 within the tube 36 in a closed configuration.

Figure 14:
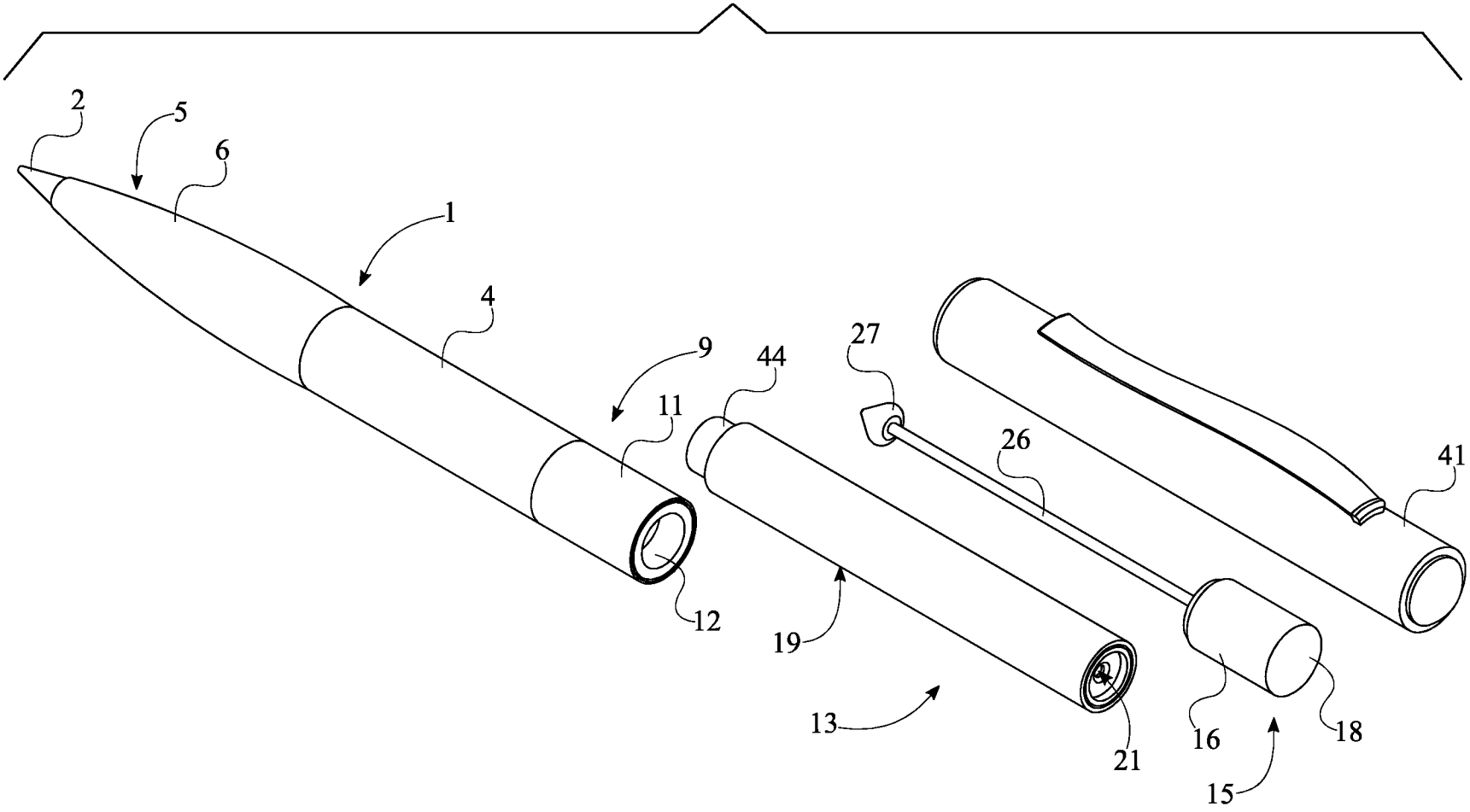
FIG. 14 is a top exploded view of a fifth alternate embodiment of the present invention with the at least one cosmetic tool and the cover separated from the present invention.
Figure 15:
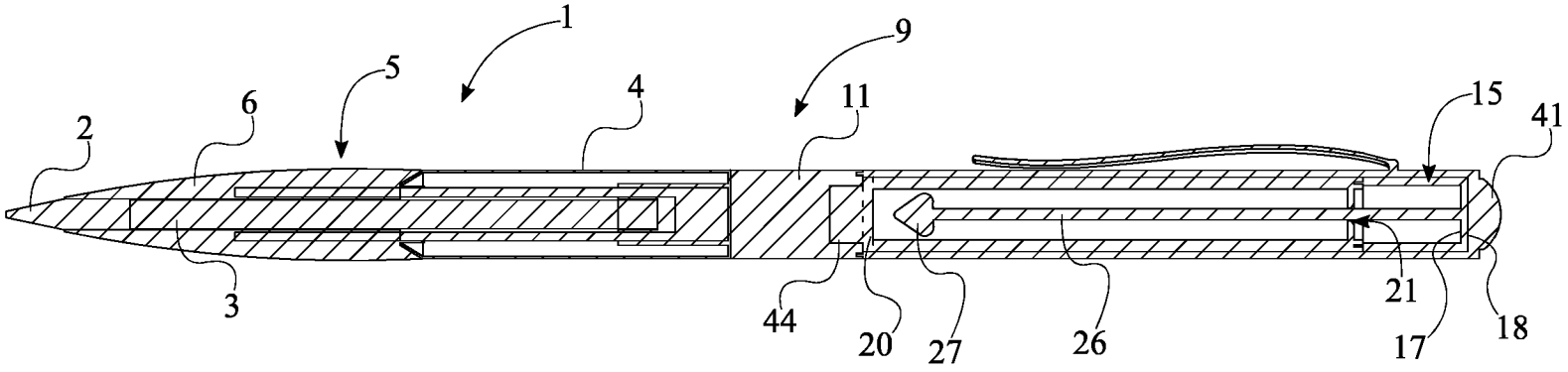
FIG. 15 is a cross-section view of FIG. 5 along line A-A of the fifth embodiment of the present invention.
Figure 16:
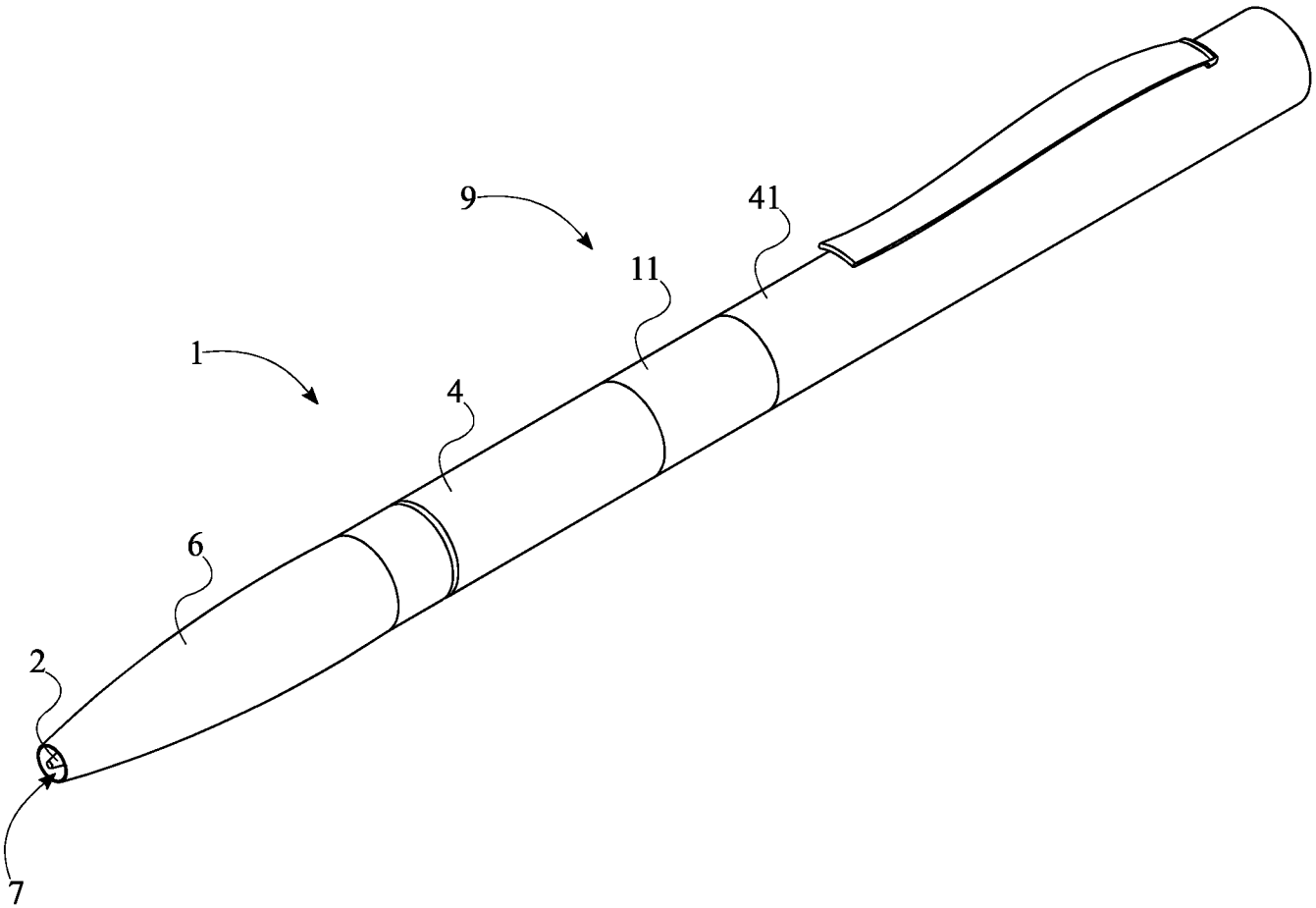
FIG. 16 is a bottom perspective view of the preferred embodiment of the present invention with a dispensing tip retracted within a tubular case of a twist mechanism.

In a fifth embodiment of the present invention, the at least one cosmetic tool 13 is an eyeshadow applicator, shown in FIG. 14 and FIG. 15. In this embodiment the at least one cosmetic tool 13 comprises a tube 19, a shaft 26, and an eyeshadow sponge 27. The tube 19 contains and houses the shaft 26 and the eyeshadow sponge 27. Similarly, the tube 19 may also contain eyeshadow powder or eyeshadow cream. The shaft 26 positions the eyeshadow sponge 27, in order to protect and conceal the eyeshadow sponge 27, as well as access the eyeshadow powder or eye shadow cream within the tube 19. The eyeshadow sponge 27 applies eyeshadow cream or eyeshadow powder onto at least one surface, the at least one surface preferably being an eyelid. Furthermore, the cap 15 comprises a lateral wall 16, an inner surface 17, and an outer surface 18. The inner surface 17 is positioned opposite the outer surface 18 about the lateral wall 16. In order to secure the tube 19, the adapter 9 is connected to a tube base 20 of the tube 19, opposite an opening 21 of the tube 19. The inner surface 17 is positioned adjacent the opening 21 of the tube 19 in order to close the at least one cosmetic tool 13. The eyeshadow sponge 27 is positioned within the tube 19 in a closed configuration as the shaft 26 is mounted to the inner surface 17 of the cap 15, and the eyeshadow sponge 27 is fixed to the shaft 26, opposite the cap 15. Moreover, the cap 15 is removably attached to the tube 19.

In alternate embodiments of the present invention, it is understood that, a variety of cosmetics and a variety of brushes and applicators may be integrated into the at least one cosmetic tool 13. Moreover, hygiene items may be integrated into the at least one cosmetic tool 13 and corresponding dispensers and applicators.

Although the invention has been explained in relation to its preferred embodiment, it is to be understood that many other possible modifications and variations can be made without departing from the spirit and scope of the invention as hereinafter claimed.

What is claimed is:

1. A modular cosmetic writing instrument comprising:

a writing instrument;

an adapter;

at least one cosmetic tool;

a cover;

a gripping sleeve;

a writing instrument cap;

the writing instrument comprising a dispensing tip, a chamber, a barrel and a twist mechanism;

the at least one cosmetic tool comprising a cosmetic applicator, an applicator cap, a main shaft, a tool base, a rod, a bed, a sleeve and a tube;

the dispensing tip being in fluid communication with the chamber;

the chamber being mounted within the barrel;

the dispensing tip being externally positioned to the barrel;

the adapter being fixed to the barrel;

the adapter being oppositely positioned to the chamber;

the cosmetic applicator being connected to the adapter;

the cosmetic applicator being oppositely positioned to the barrel;

the applicator cap being removably attached to the cosmetic applicator;

the applicator cap being oppositely positioned to the adapter;

the cover being removably attached to the adapter over the at least one cosmetic tool;

the writing instrument, the adapter and the at least one cosmetic tool being positioned concentrically with each other;

the twist mechanism being rotatably connected to the barrel;

the twist mechanism being oppositely positioned to the adapter;

the twist mechanism being operatively coupled with the chamber;

the twist mechanism being configured to extend and retract the dispensing tip within an opening of a tubular casing of the twist mechanism;

the gripping sleeve being mounted around the tubular casing;

the writing instrument cap being removably attached to the barrel over the dispensing tip;

the adapter comprising an adapter base and a shaft-receiving slot;

the shaft-receiving slot concentrically traversing into the adapter base;

the shaft-receiving slot being oppositely positioned to the barrel;

the main shaft being terminally fixed to the cosmetic applicator;

the main shaft being oppositely positioned to the applicator cap;

the main shaft being threadedly engaged with and inserted into the shaft-receiving slot;

the adapter being connected to the tool base;

the adapter being oppositely positioned to an opening of the tool base;

the tube being rotatably coupled to the tool base;

the tube being oppositely positioned to the adapter;

the sleeve being terminally mounted within the tube;

the sleeve being adjacently positioned to the tool base;

the rod being threadedly engaged with the sleeve and the opening of the tool base;

the bed being terminally fixed to the rod;

an opening of the bed being adjacently positioned to an opening of the tube;

the opening of the tube being oppositely positioned to the tool base; and the applicator cap being removably attached to the tool base over the tube.

2. The modular cosmetic writing instrument as claimed in claim 1 comprises:

the at least one cosmetic tool comprises a tube and a rollerball;

the adapter being connected to a base of the tube, opposite an opening of the tube;

the rollerball being mounted to the tube, adjacent the opening of the tube; and, the cap being removably attached to the tube over the rollerball.

3. The modular cosmetic writing instrument as claimed in claim 1 comprises:

the at least one cosmetic tool comprises a tube and a mist spray pump;

the adapter being connected to a base of the tube, opposite an opening of the tube;

the mist spray pump being mounted to the tube, adjacent the opening of the tube;

a supply tube of the mist spray pump being positioned within the tube;

a spray nozzle of the mist spray pump being positioned external to the tube;

the spray nozzle being in fluid communication with the supply tube; and, the cap being removably attached to the tube over the spray nozzle.

4. The modular cosmetic writing instrument as claimed in claim 1 comprises:

the at least one cosmetic tool comprises a tube, a shaft, and mascara brush;

the shaft being mounted to the adapter, opposite the barrel of the writing instrument;

the mascara brush being fixed to the shaft, opposite the adapter;

the cap being connected to a base of the tube, opposite an opening of the tube;

the adapter being positioned adjacent the opening of the tube; and, the tube being removably attached to the adapter.

5. The modular cosmetic writing instrument as claimed in claim 1 comprises:

the at least one cosmetic tool comprises a tube, a shaft, and an eyeshadow sponge;

the cap comprises a lateral wall, an inner surface, and an outer surface;

the adapter being connected to a base of the tube, opposite an opening of the tube;

the inner surface being positioned opposite the outer surface about the lateral wall;

the inner surface being positioned adjacent the opening of the tube;

the shaft being mounted to the inner surface of the cap;

the eyeshadow sponge being fixed to the shaft, opposite the cap; and, the cap being removably attached to the tube.

* * * * *